US006934592B2

(12) United States Patent
Hood et al.

(10) Patent No.: US 6,934,592 B2
(45) Date of Patent: Aug. 23, 2005

(54) HOUSEHOLD APPLIANCE WITH ADVERTISING DISPLAY MODE

(75) Inventors: Kimberly J. Hood, Mitchellville, IA (US); Brian L. Ness, Newton, IA (US); Brett A. Noser, Highlands Ranch, CO (US); Douglas A. Ochsner, Newton, IA (US); Brett C. Oleson, Newton, IA (US); Stephen D. Schober, Newton, IA (US); Lashelle D. Woods, Newton, IA (US)

(73) Assignee: Maytag Corporation, Newton, IA (US)

( * ) Notice: Subject to any disclaimer, the term of this patent is extended or adjusted under 35 U.S.C. 154(b) by 391 days.

(21) Appl. No.: 09/919,864

(22) Filed: Aug. 2, 2001

(65) Prior Publication Data

US 2003/0028259 A1 Feb. 6, 2003

(51) Int. Cl.[7] ..... G05B 15/00; D06F 33/02

(52) U.S. Cl. ..... 700/83; 700/17; 68/12.27

(58) Field of Search ..... 700/1, 17, 83; 68/12.27; 707/101, 102; 702/188; 348/61, 121; 705/14

(56) References Cited

U.S. PATENT DOCUMENTS

| | | | | |
|---|---|---|---|---|
| 4,977,394 A | * | 12/1990 | Manson et al. | 340/679 |
| 5,124,908 A | | 6/1992 | Broadbent | |
| 5,250,789 A | | 10/1993 | Johnsen | |
| 5,410,326 A | * | 4/1995 | Goldstein | 348/734 |
| 5,694,793 A | * | 12/1997 | Nishimura et al. | 68/12.27 |
| 5,761,601 A | * | 6/1998 | Nemirofsky et al. | 725/34 |
| 5,839,097 A | * | 11/1998 | Klausner | 340/825.69 |
| 6,002,450 A | | 12/1999 | Darbee et al. | |
| 6,134,906 A | * | 10/2000 | Eastman | 62/331 |
| 6,152,591 A | | 11/2000 | McCall et al. | |
| 6,177,880 B1 | | 1/2001 | Begum | |
| 6,228,716 B1 | * | 5/2001 | Wanlass | 438/264 |
| 6,243,772 B1 | * | 6/2001 | Ghori et al. | 710/68 |
| 6,321,474 B1 | * | 11/2001 | Pearson | 40/509 |
| 6,453,687 B2 | * | 9/2002 | Sharood et al. | 62/127 |
| 6,480,753 B1 | * | 11/2002 | Calder et al. | 700/83 |
| 6,502,265 B2 | * | 1/2003 | Blair et al. | 8/159 |
| 6,519,571 B1 | * | 2/2003 | Guheen et al. | 705/14 |
| 6,539,570 B2 | * | 4/2003 | Youn et al. | 8/159 |
| 6,559,882 B1 | * | 5/2003 | Kerchner | 348/61 |
| 6,587,739 B1 | * | 7/2003 | Abrams et al. | 700/83 |
| 6,611,810 B1 | * | 8/2003 | Kolls | 705/14 |
| 6,654,757 B1 | * | 11/2003 | Stern | 707/101 |
| 2002/0120502 A1 | * | 8/2002 | Sakaguchi | 705/14 |

FOREIGN PATENT DOCUMENTS

| | | | | |
|---|---|---|---|---|
| WO | WO0137595 A1 | * | 5/2001 | H04Q/7/22 |

* cited by examiner

*Primary Examiner*—Larry D. Donaghue
*Assistant Examiner*—Aaron C Perez-Daple
(74) *Attorney, Agent, or Firm*—Diederiks & Whitelaw, PLC; Allan P. Orsund

(57) ABSTRACT

A household appliance is provided with a visual display, as well as a control system which enables the visual display to be used in an advertising mode of operation. The advertising mode can be selectively operated in either automatic or interactive formats. In the automatic format, a series of screens are successively displayed on the screen in order to advertise various features and advantages of the appliance. In the interactive format, the consumer can enter desired selections through the screen as if the appliance was actually in use. The appliance then simulates an operation cycle based on the selections made. The selections are preferably stored in a volatile memory location such that the control system reverts back to default settings and options, either after a preset idle period or upon establishing an OFF condition for the appliance.

20 Claims, 4 Drawing Sheets

HOUSEHOLD APPLIANCE WITH ADVERTISING DISPLAY MODE

BACKGROUND OF THE INVENTION

1. Field of the Invention

The present invention pertains to the art of household appliances and, more particularly, to the presentation of advertising information on an active visual display of a household appliance.

2. Discussion of the Prior Art

Manufacturers of products rely upon advertising to make consumers aware of their products. For instance, manufacturers utilize commercials, magazines and newspaper ads, advertising stickers, packaging and the like to bring attention to products. For some products, demonstration models are made available. The more competitive a particular industry, the more important it is to adequately inform a consumer as to the benefits of a product in order to enable the consumer to make an educated buying decision. On a showroom floor, it is often the knowledge of sales personnel which determines the amount of information available to a consumer on a particular product.

In most instances, a manufacturer will not desire to rely on sales personnel as the sole source of information on a product. That is, a salesperson may be busy with one customer so that he/she is not available to answer questions from a new customer. In addition, the specific level of knowledge regarding a particular product will almost certainly vary between different sales people. Under certain circumstances, a dedicated video display could be advantageously provided to convey certain information to the consumers. Even more beneficial would be an interactive display which would enable the consumer to learn about features which are of particular interest. However, providing a dedicated, interactive display is typically not feasible, particularly given the actually limited amount of available space in stores.

These concerns are particularly true in connection with the sale of appliances for household use, e.g., washing machines, dryers, dishwashers, ranges, refrigerators and the like. That is, there exists a need in this art to make automatically available, particular information concerning various features of a given household appliance in order to inform a consumer on benefits and features of the appliance. It would also be desirable to enable the consumer to interact with the appliance in order to obtain even farther details on the operation of the appliance. However, to date, appliances have not been made with control and display arrangements which enable these functions to be performed.

SUMMARY OF THE INVENTION

The present invention is directed to incorporating a visual display in a household appliance, as well as a control system which enables the visual display to be used in an advertising mode of operation. In accordance with the most preferred form of the invention, the visual display constitutes an LCD touch screen through which a user can input control parameters into and access information from the appliance. Most preferably, the advertising mode can be selectively operated in either automatic or interactive formats. In the automatic format, a series of screens are successively displayed in order to advertise various features and advantages of the appliance. In the interactive format, the consumer can enter desired selections through the screen as if the appliance was actually in use. The appliance then simulates an operation cycle based on the desired selections. The selections are preferably stored in a volatile memory location such that the control system reverts back to default settings and options, either after a preset idle period or upon establishing an OFF condition for the appliance.

With this arrangement, a consumer can readily learn special features and advantages of the appliance in a user friendly and entertaining manner. In addition to potentially attracting customers to the appliance, less reliance is placed on the availability or particular knowledge of individual sales personnel. Since the display is also advantageous utilized in connection with controlling the appliance, the added cost associated with providing the advertising mode feature is minimal, thereby making the overall arrangement cost effective.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
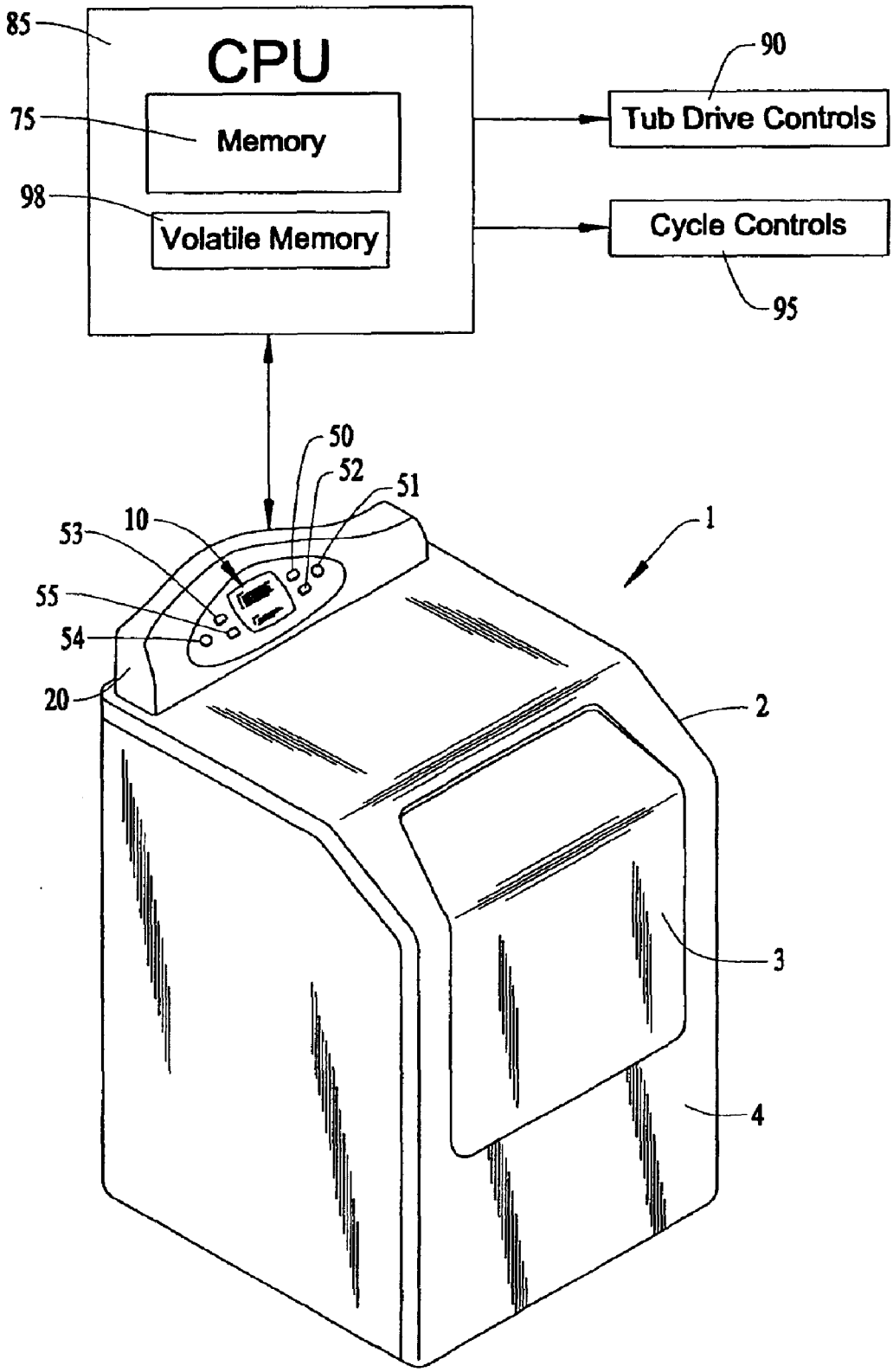
FIG. 1 is a perspective view of a washing machine incorporating the advertising display mode of the present invention.

For purposes of explaining the present invention, reference is initially made to FIG. 1 in describing the construction and operation of an exemplary household appliance 1 shown as a clothes washing machine. Appliance 1 includes a cabinet 2 provided with a door 3 in a front face 4. Door 3 is designed to be pivoted to expose an integral washing tub (not shown). A display 10 is integrated into a control panel 20 through which a user can control and program washing appliance 1. In addition, in accordance with the present invention, display 10 is also advantageously used in connection with an advertising mode for appliance 1 as will be detailed below.

As shown, appliance 1 preferably includes various control buttons 50–56 shown about display 10. More specifically, an "OFF" button 50 is provided to selectively turn off or reset laundry appliance 1. Button 51 constitutes a "START/PAUSE" button used to initiate or pause a selected washing operation. A "HELP" button 52 is provided to enter a help control mode used to aid a user in addressing potential washing or operating concerns. A "HOME" button 53 is used to enter another control mode which will also be discussed fully below. Button 54 enables direct access to "FAVORITES" relating to preferred cycle parameters stored by a user in a memory 75 of a CPU 85 used to regulate tub drive controls, generally indicated at 90, and cycle controls 95. As will be more fully discussed below, CPU 85 also preferably incorporates a volatile memory 98. Finally, a "BACK" button 55 is provided to erase an inadvertently inputted control parameter or revert back to a prior screen on display 10. As will also become more fully evident below, the particular control configuration for appliance 1 can significantly vary in accordance with the present invention.

The present invention is particularly directed to the selective use of appliance 1 in an advertising mode of operation. Although the input of cycle parameters for a desired washing operation can be accomplished in many different ways in accordance with the present invention, in the preferred embodiment, the input of cycle parameters is performed through display 10. That is, in the most preferred form of the invention, display 10 takes the form of an LCD touch screen, such as a 128×96 dot matrix, touch screen display, which enables a user to readily review displayed data, preferably in alpha or word text format, and select from that data to establish and begin a desired washing operation, as well as retrieve a wide range of information regarding appliance 1. Furthermore, display 10 can be advantageously used to present a wide range of advertising information to a consumer.

Figure 2:
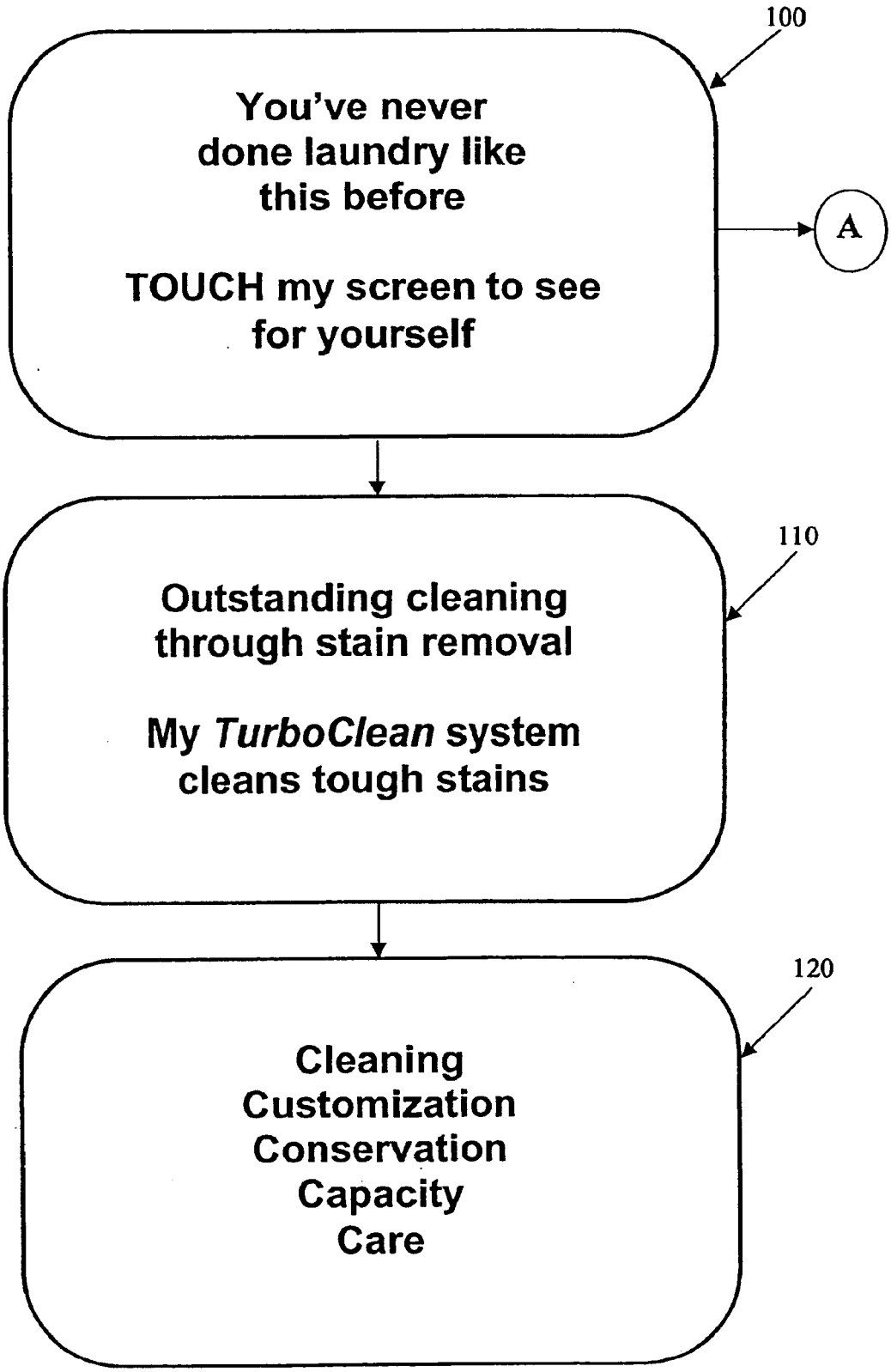
FIG. 2 illustrates an exemplary instruction screen sequence presented in accordance with an automatic advertising format of the present invention.

More particularly, in accordance with the most preferred form of the invention, a pre-established control operation will place CPU 85 in an advertising mode of operation. Although this control operation could be easily varied, the preferred embodiment requires the depression of the "HELP" and "FAVORITES" buttons 52 and 54 simultaneously for five seconds. The same control operation or a disconnection of appliance 1 from a power source will function to deactivate the advertising mode. In any event, upon entering the advertising mode, which would most likely be done by sales personnel, screen 100 shown in FIG. 2 is presented in display 10. As can be readily seen from this figure, screen 100 displays one or more advertising messages, as well as invites a consumer to interact with appliance 1 by simply touching screen 100. If screen 100 is not touched within a predetermined time limit, e.g. five seconds, the advertising mode of appliance 1 will enter an automatic format wherein a plurality of successive advertising screens will be presented in display 10 in a timed manner. It should be realized that the actual wording and/or graphics presented can greatly vary in accordance with the invention, mainly based on the particular type of appliance to which the invention is applied and the available features of the appliance.

For illustration purposes, FIG. 2 shows additional screens 110 and 120 which are preferably presented in display 10 in a timed manner as part of the automatic advertising mode format. Since the invention is being described with respect to a clothes washing machine, screens 110 and 120 provide certain information to the consumer directed to particular advantages of that specific type of appliance, such as cleaning, customizing, water conservation/efficiency, load capacity and/or care features. Again, a wide variety of advertising information can be presented such that screens 110 and 120 should only be considered representative of the type of information which can be shown. Eventually, display 10 will revert back to screen 100 and the cycle will continue.

Figure 3A:
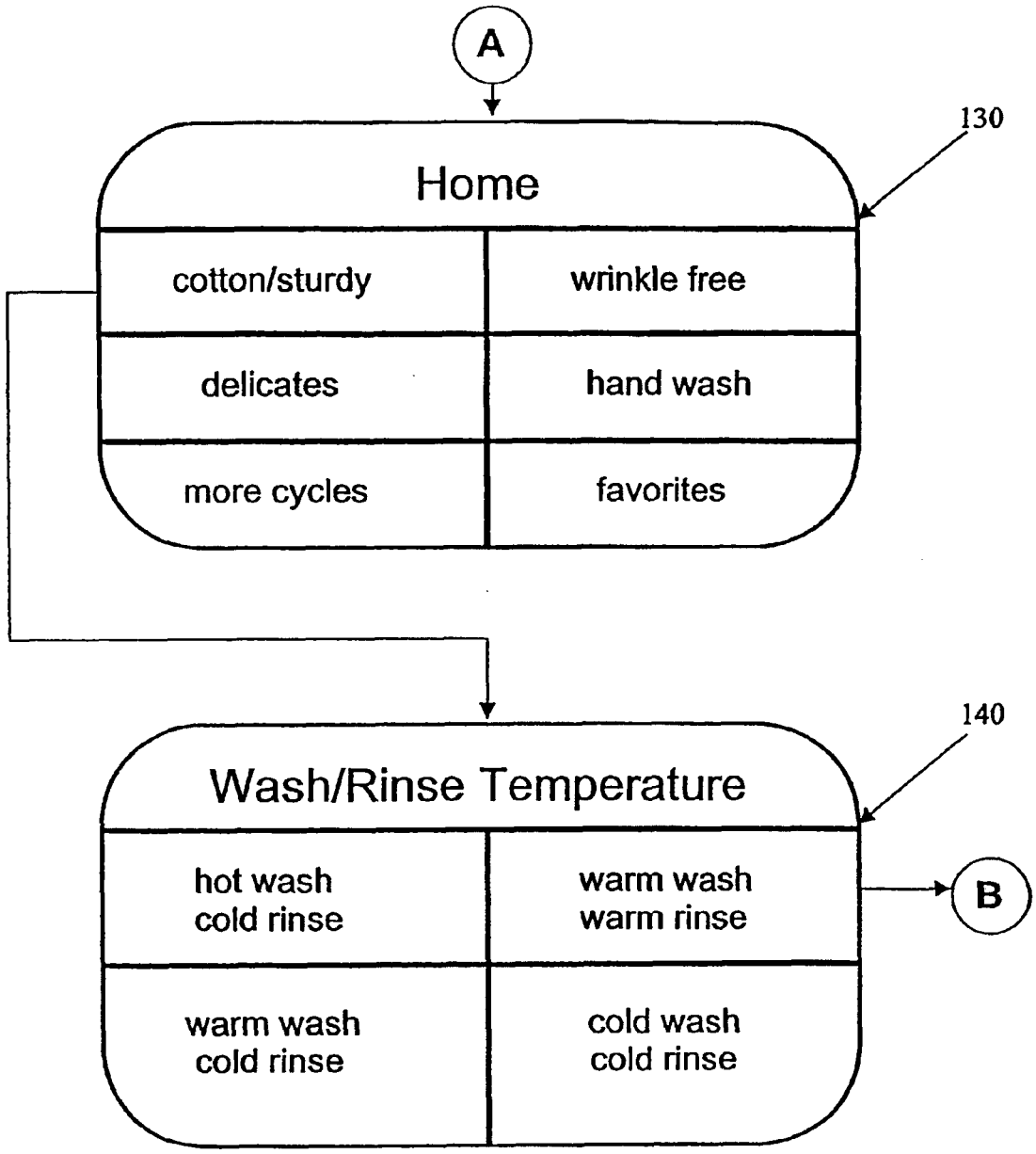
FIG. 3A is a partial screen sequence available when the advertising display mode feature is placed in an interactive format in accordance with the present invention.
Figure 3B:
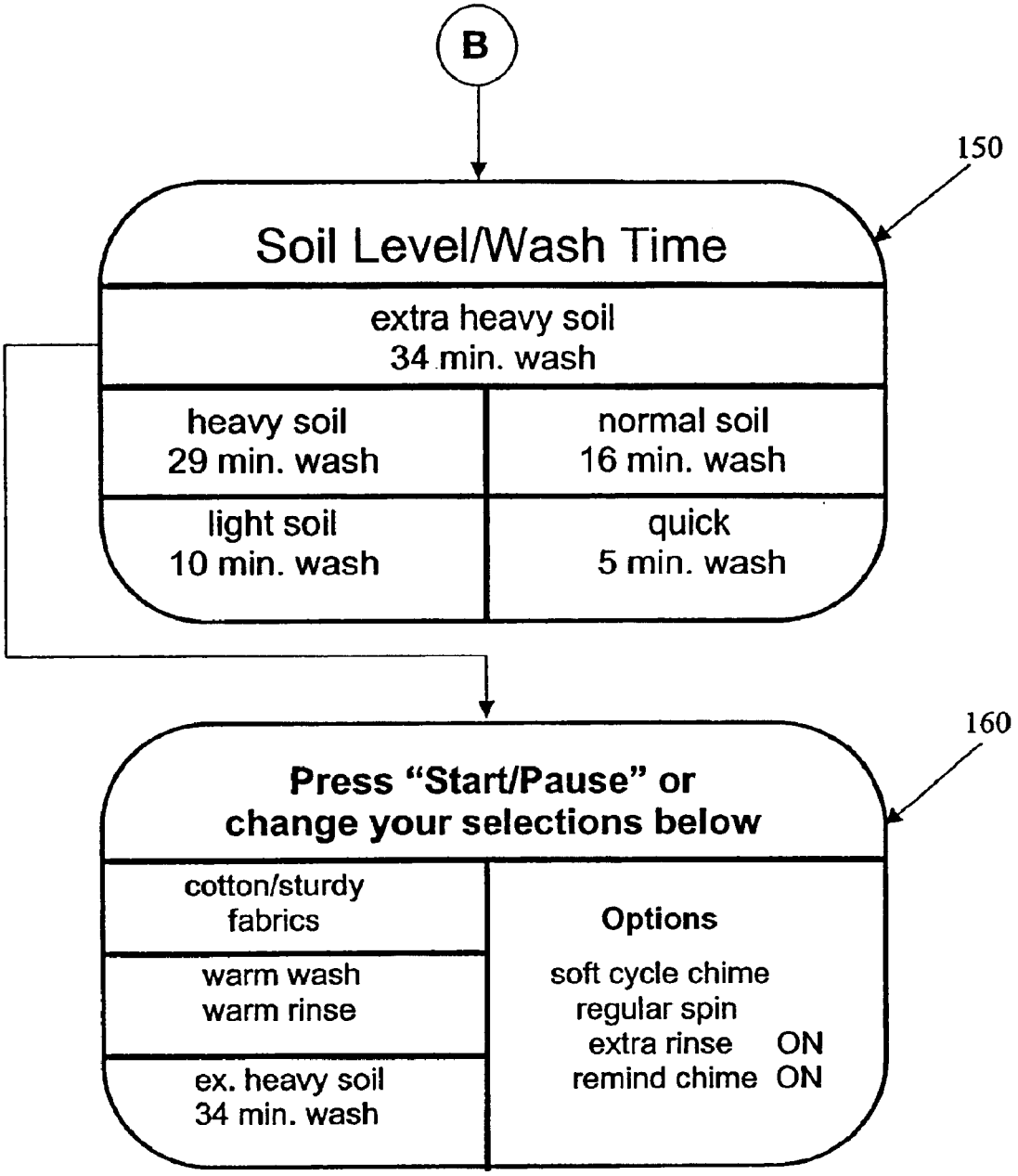
FIG. 3B is a further partial screen sequence available when the advertising display mode feature is placed in the interactive format of the invention.

FIGS. 3A and 3B depict a preferred screen sequence used to illustrate the manner in which potential cycle inputs are presented to a consumer if screen 100 is touched, thereby switching the advertising mode to an interactive format. In general, in the example shown, the consumer is directed through a typical wash cycle input control sequence to indicate how an operator would be required to input at least the particular fabric type, wash/rinse temperature and soil level/wash time before initiating a washing operation with appliance 1. To this end, screen 130 is initially presented to the user on display 10 upon touching screen 100. Actually, screen 130 can also be accessed by pressing "HOME" button 53. As shown, screen 130 preferably presents various fabric type options for appliance 1. With screen 130 displayed, the consumer can select a desired cycle input by simply touching the corresponding portion of display 10. As shown, the consumer is provided with the option of selecting between "cotton/sturdy", "wrinkle free", "delicates" or "hand wash" fabric types.

On the other hand, the consumer could select "more cycles" for other potential wash and/or special rinse cycles. The "favorites" option is preferably provided in connection with enabling a consumer to store desired cycle parameters relating to specific loads which are continuously washed. For example, the actual user of appliance 1 may have uniforms or grass-stained clothing that need to be periodically washed utilizing a consistent set of wash cycle parameters. Therefore, instead of requiring the user to re-input the overall set of wash cycle parameters each time, these "favorites" can be stored in memory 75 of CPU 85 for easy access. Under this section, the "favorites" cycles can preferably by given personal titles through an alpha keyboard screen, i.e., a screen depicting all the letters of the alphabet, (not shown) presented on display 10.

In the example provided, the consumer has selected the "cotton/sturdy" fabric type through screen 130. This selection causes display 10 to automatically convert to screen 140 wherein the consumer will be prompted to input a desired wash/rinse temperature. As shown, the consumer preferably can select between "hot wash/cold rinse", "warm wash/warm rinse", "warm wash/cold rinse" and "cold wash/cold rinse" options. For exemplary purposes, the "warm wash/warm rinse" option has been selected which causes screen 150 as shown in FIG. 3B to be presented on display 10. Screen 150 enables the final, required cycle parameter, i.e., the soil level/wash time, to be selected. Again, although shown just with respect to a preferred embodiment of the invention, the consumer has the option of selecting between "extra heavy soil—34 min. wash", "heavy soil—29 min. wash", "normal soil—16 min. wash", "light soil—10 min. wash" and "quick—5 min. wash". As shown, the "extra heavy soil—34 min. wash" option has been selected, thereby resulting in the presentation of screen 160 in display 10.

During this interactive sequence, the various parameters selected by the consumer are preferably, temporarily stored in volatile or nonpermanent memory 98. The information stored in memory 98 is preferably only retained temporarily as it pertains to the inputs for a particular consumer. Therefore, it is desired to periodically erase volatile memory 98 for each interactive cycle, i.e., CPU 85 reverts the system back to default settings and options either after a preset idle period or upon establishing an OFF condition for the appliance. However, as shown by screen 160, it is desired in accordance with the invention to provide the consumer with a summary of selected cycle parameters, as well as a list of further options which could be established by a user based on personal preferences. Screen 160 is actually made available to enable a consumer or user to approve the collective cycle parameters selected prior to proceeding. If changes are desired, the particular selected parameter can be highlighted through screen 160 or "BACK" button 55 can be used to revert back to prior selection screens. At this time, the depression of "START/PAUSE" button 51 will initiate a simulated laundering operation, e.g., by simply presenting additional washing information on display 10, such as a wash cycle countdown timer, and/or rotating the tub of appliance 1.

Again, the manual input sequence described above with respect to the interactive advertising mode format is provided by way of example and would obvious differ depending on the type of household appliance to which the invention is applied. However, regardless of the particular information provided under the automatic format or the sequence followed under the interactive format, it should be readily apparent that the advertising mode arrangement of the present invention provides a cost effective and efficient advertising system which advantageously takes advantage of the employment of display 10 in the appliance. With this arrangement, a consumer can be educated on special features and advantages of the appliance in a user friendly and entertaining manner. In addition to potentially attracting customers to the appliance, less reliance is placed on the availability or particular knowledge of individual sales personnel. In any event, although described with reference to a preferred embodiment of the invention, it should be readily understood that various changes and/or modifications can be made to the invention without departing from the spirit thereof. Instead, the invention is only intended to be limited by the scope of the following claims.

What is claimed is:

1. A household appliance comprising:

a cabinet;

a display mounted to the cabinet, said display being adapted to present a plurality of visual screens to a consumer;

control means for controlling the appliance and for establishing an advertising mode of operation wherein information concerning the household appliance is presented on the plurality of screens for educating the consumer on the household appliance, wherein said household appliance is selected from the group consisting of a washing machine, a dryer, a dishwasher, a range and a refrigerator; and memory for storing the information concerning the household appliance.

2. The household appliance according to claim 1, wherein the information concerns particular features of the household appliance.

3. The household appliance according to claim 1, wherein the information concerns programming features of the household appliance.

4. The household appliance according to claim 1, wherein the control means receives desired cycle parameters selected by the consumer for a simulated appliance operation.

5. The household appliance according to claim 4, wherein the display constitutes a touch screen display through which the desired cycle parameters are inputted by the consumer.

6. The household appliance according to claim 5, further comprising: non-permanent memory in which the desired cycle parameters are temporarily stored.

7. The household appliance according to claim 1, wherein the display constitutes a touch screen display through which input parameters can be entered into the control means.

8. The household appliance according to claim 1, wherein said control means further includes means for establishing automatic and interactive formats of the advertising mode.

9. The household appliance according to claim 8, wherein the plurality of screens are successively displayed in a timed manner under the automatic format.

10. The household appliance according to claim 9, wherein each of the plurality of screens is paused for receiving operator input parameters under the interactive format.

11. A method of operating a household appliance including a controller and a memory, wherein the controller performs the tasks of:

controlling the appliance;

establishing an advertising mode of operation; and providing information stored in the memory to educate a consumer about the household appliance on a screen of a display incorporated into the household appliance, wherein said household appliance is selected from the group consisting of a washing machine, a dryer, a dishwasher, a range and a refrigerator.

12. The method of claim 11, wherein information is conveyed concerning particular features of the household appliance.

13. The method of claim 11, wherein information is conveyed concerning programming of the household appliance.

14. The method of claim 11, further comprising:

visually prompting the consumer for an input; and entering an interactive format of the advertising mode upon receiving the input from the consumer.

15. The method of claim 14, further comprising: entering an automatic format of the advertising mode when the input is not received by the consumer.

16. The method of claim 15, further comprising: presenting a series of successive informational screens in the display, in a timed manner, while in the automatic format.

17. The method of claim 15, further comprising: receiving the input through the touching of the display by the consumer.

18. The method of claim 14, further comprising:

prompting the consumer for desired cycle parameters; and simulating a cycle operation based on the desired cycle parameters.

19. The method of claim 18, further comprising: storing the desired cycle parameters inputted by the consumer in non-permanent memory.

20. The method of claim 19, further comprising: erasing the non-permanent memory when the display of the appliance is idle for a predetermined period of time.

* * * * *